United States Patent [19]

Thompson et al.

[11] Patent Number: 4,974,804

[45] Date of Patent: Dec. 4, 1990

[54] HOLD DOWN CLIP FOR ELECTRIC RANGE SURFACE ELEMENTS

[75] Inventors: Joseph E. Thompson, Pleasant Township, Marion County, Ohio; Kenneth L. Davis, Fort Wayne, Ind.

[73] Assignee: Whirlpool Corporation, Benton Harbor, Mich.

[21] Appl. No.: 430,336

[22] Filed: Nov. 2, 1989

Related U.S. Application Data

[62] Division of Ser. No. 295,499, Jan. 11, 1989, Pat. No. 4,906,819.

[51] Int. Cl.[5] ..... A47G 1/10

[52] U.S. Cl. ..... 248/316.7; 248/300

[58] Field of Search ..... 248/316.7, 264, 300; 219/463, 455, 467; 24/532, 457, 458

[56] References Cited

U.S. PATENT DOCUMENTS

| | | | |
|---|---|---|---|
| 861,732 | 7/1907 | Kellum | 248/264 |
| 2,070,498 | 2/1937 | Tournier . | |
| 2,087,756 | 7/1937 | Farkas | 24/532 X |
| 2,260,791 | 10/1941 | Green . | |
| 2,467,348 | 4/1949 | Tuttle . | |
| 3,056,012 | 9/1962 | Hanson . | |
| 3,069,539 | 12/1962 | Kidd | 248/316.7 X |
| 3,327,966 | 8/1965 | Jasionowski . | |
| 3,550,887 | 12/1970 | Kwiatkowski | 248/316.7 X |
| 3,574,964 | 4/1971 | Ownbey | 248/316.7 X |
| 4,378,485 | 3/1983 | Fitzmayer et al. . | |
| 4,388,519 | 6/1983 | Dooley . | |
| 4,872,631 | 10/1989 | Rutigliano . | |

*Primary Examiner*—J. Franklin Foss

*Attorney, Agent, or Firm*—Hill, Van Santen, Steadman & Simpson

[57] ABSTRACT

A hold down or retaining clip is provided for removably securing a supporting spider for a heating element to a top wall of an appliance such as an electric range. Generally in such appliances there is a burner bowl in which the spider and heating element are supported, and the clip, which is secured to the top wall, has upwardly extending arms which project through the bowl to resiliently engage the spider to secure the spider to the top wall. The clip also indirectly secures the burner bowl to the top wall in that the spider rests on top of the burner bowl when installed, which in turn rests on top of the top wall of the appliance.

12 Claims, 2 Drawing Sheets

HOLD DOWN CLIP FOR ELECTRIC RANGE SURFACE ELEMENTS

CROSS REFERENCED TO RELATED APPLICATION

This application is a Rule 60 divisional of U.S. Ser. No. 295,499, filed Jan. 11, 1989 now U.S. Pat. No. 4,906,819.

BACKGROUND OF THE INVENTION

The present invention relates to retainer clips and more particularly to retainer clips for use in association with appliances such as electric ranges to secure and stabilize the surface units.

Several types of appliances such as ranges, cooktops, and the like have plug-in surface elements which are subject to some rattling due to vibrations since the elements are usually supported by a spider within the burner bowl and thus are free to move vertically and horizontally relative to the burner bowl. Oftentimes the burner bowl is also free to move horizontally and is subject to rattling vibrations.

U.S. Pat. No. 4,388,519 discloses a heater element having a positioning member attached to the element support and formed with a detent portion which is held by fastening means to secure the element support to the cooktop flange. Additionally, a resilient thermal insulating pad means is positioned on the upper edge portion of the support arms so as to be interposed between the heater element and the element support. The fastening means is in the form of a spring detent which is positioned below the pan in which the elements sits, thus there is no visual indication that the positioning member is correctly seated or is fully inserted.

U.S. Pat. No. 3,327,966 discloses a support for a coiled electric heating element, the support comprising a U-shaped spring clip which secures the spider to the heating element. This support does not secure the heater element to the cooktop, nor does it appear to prevent vibration of the element.

U.S. Pat. No. 2,260,791 discloses an electric heater element having support arms with tapered notches on their lower surfaces near their ends. These notched ends are adapted to extend downwardly within supporting lugs in the pan structure to prevent horizontal movement between the heating element and the pan structure. This support does not secure the heater element to the cooktop, nor does it appear to prevent vibration of the element.

U.S. Pat. No. 3,056,012 discloses an electric heater element having support arms with notched end portions for receiving a leaf spring mounted to an adapter ring. The leaf spring has a fold that projects through openings in the adapter ring, the adapter ring being loosely supported by the cooktop. This support does not secure the heater element to the cooktop, nor does it appear to prevent vibration of the element.

U.S. Pat. No. 2,467,348 discloses an electric heater element hingedly mounted to a reflector pan and affixed to a plurality of support arms. The support arm opposite the hinge has a notched end portion for receiving a tongue or latch member struck from the upright side wall of the pan. To release the element, the latch, and presumably the entire burner pan, is moved slightly to the side to release the latch from the notch. This support does not secure the heater element to the cooktop, nor does it appear to prevent vibration of the heater element.

U.S. Pat. No. 2,070,498 discloses an electric heater element for a hot plate mounted on a ring and supported by a cross-shaped support grid. Projecting upwardly form the ring are spaced upright lugs for guiding and locating the heater element support arms. The lugs do not secure the heater element to the ring, the burner bowl to the hot plate, and do not prevent vibration of the heater element or burner bowl.

U.S. Pat. No. 4,378,485 discloses a support system for cushioning vibrations in an electric heater element, the system having resilient thermally insulating means disposed between the heater element and the support arms, between the support arms and the burner bowl, and between the burner bowl and the cooktop. No provision is made for firmly securing the support arms to the cooktop, also it would appear that the cushioning means are subject to wear or loss, thereby requiring replacement.

SUMMARY OF THE INvENTION

The present invention provides a simple, yet effective solution to prevent noise and vibration of the heating element in a cooktop or range in that a hold down or retainer clip functions to hold down the coiled heating element and also eliminates reflector or burner bowl rattle. The retainer clip not only provides a tactile feedback to the user when the heating element surface unit is correctly located and secured, in the form of a secure feel, the clip is arranged in a visible position so that visual confirmation of proper placement is assured.

Only one retainer clip is required for each surface unit, however, additional clips do not impede the function of the cooktop. The retainer clip can be used with either a one-piece burner bowl, otherwise known as a combination pan, or a two piece burner bowl otherwise known as an adapter ring and reflector pan. In presently available commercial structures, the combination pan and adapter ring are made from chrome-plated steel and the reflector pan is made from porcelain plated steel.

The method of securing the retainer clip consists of fastening the clip to a downturned flange in an opening of the range cooktop by a rivet so that the clip projects upwardly through the burner bowl. The surface unit, consisting of a standard spiral coil mounted on a spider for support, may then be lowered into the burner bowl for installation in the usual manner. The clip is spread by pressing downward on the coil element, so that the spider is forced downward to be securely held by the clip. The clip thus functions as both an aligning device and a securing device for the surface element, which prevents the surface element from rattling in the bowl, a longstanding industry problem.

DESCRIPTION OF THE PREFERRED EMBODIMENTS

Figure 1:
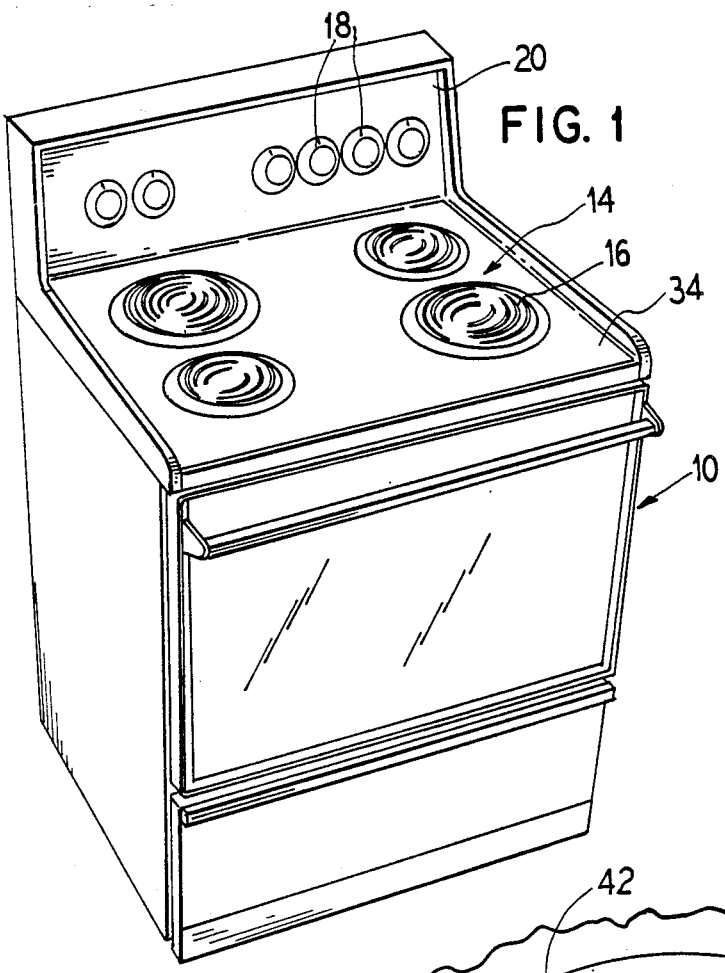
FIG. 1 is a perspective view of an appliance illustrating an electric cooktop with which a retainer clip embodying the principles of the present invention could be utilized.

In FIG. 1 there is illustrated an appliance generally at 10 which, in the illustration is depicted as an electric range although the present invention can be utilized with other types of appliances, such as stand alone cooktops, hot plates and the like.

The range 10 has a top cooking surface 14, commonly referred to as a cooktop, which includes a plurality of electric coil-type heating elements 16 controlled by control knobs 18 positioned on a rear console 20. Four such heating elements 16 are shown in FIG. 1, one of which is shown in greater detail in FIGS. 2–6.

In FIGS. 2–6 it is seen that the element 16 itself is in the shape of a spiral and has a first end 24 and a second end 26, both of which are inserted through an opening 28 in a burner pan or bowl 30. An electrical connector 32 is secured beneath a top wall 34 of the range into which the two ends 24, 26 of the heating element 16 are plugged.

Figure 2:
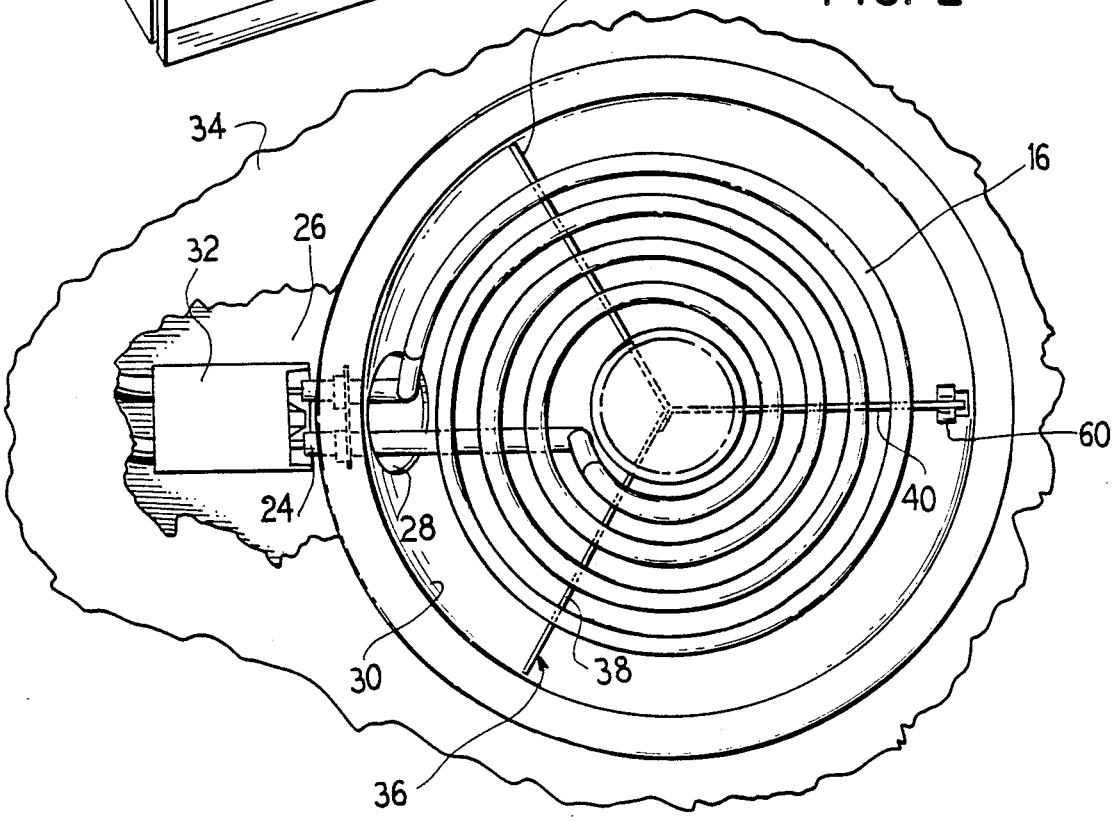
FIG. 2 is a partial top view of the cooktop illustrating the location of the clip relative to the surface unit.

The heating element 16 is supported within the burner bowl 30 and is spaced from the top wall 34 by means of a spider 36, which is shown in FIG. 2 to have three legs 38, 40, 42 formed at 120° to each other, one (40) of which is directly opposite the opening 28 in the burner bowl 30. In at least one location (44 FIG. 3), the heating element 16 is captured by the spider 36 to prevent horizontal movement of the heating element 16 on the spider 36.

Figure 3:
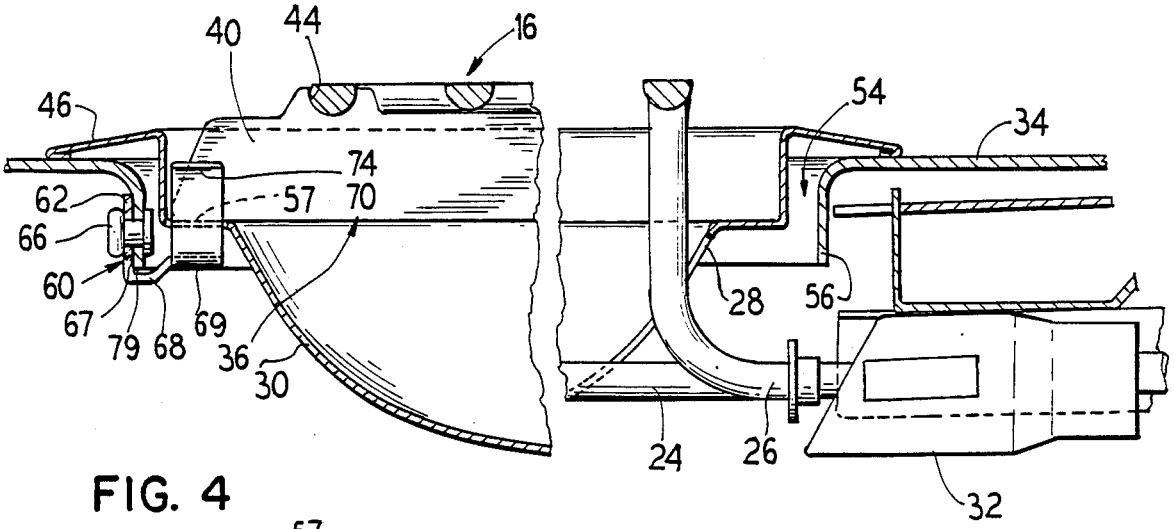
FIG. 3 is a side sectional view of the cooktop of FIG. 2.
Figure 4:
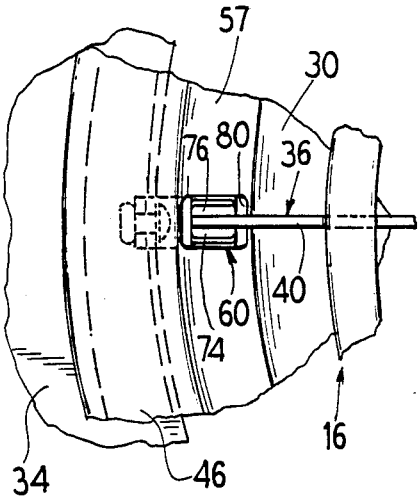
FIG. 4 is a partial top view of the surface unit in the area of the clip.
Figure 5:
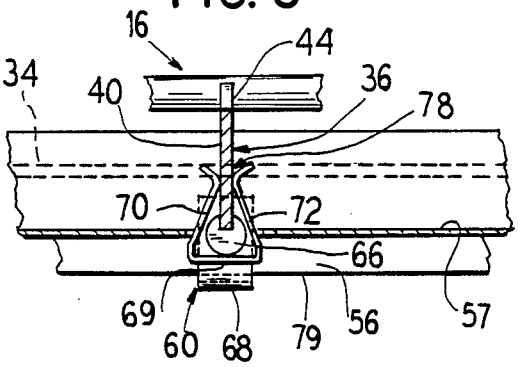
FIG. 5 is a side sectional view of the clip and surface unit.
Figure 6:
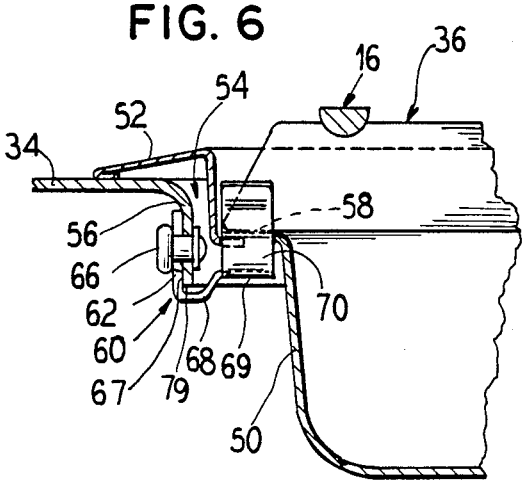
FIG. 6 a side sectional view of the clip and surface unit taken at 90° to FIG. 5.

The burner bowl 30, may be a single-piece member as shown in FIG. 3 having a trim flange 46, or may be a two-piece member, comprising a separate burner or reflector bowl 50 and a trim ring 52 as shown in FIG. 6. In either case, the burner bowl and trim ring or trim flange are positioned within a circular opening 54 in the top wall 34 of the cooktop 14 such that the burner bowl depends downwardly below the top wall 34, but is supported by that wall. The circular opening 54 is formed with a down-turned flange 56 around its circumference.

The burner bowl 30, 50 has a horizontal, annular ledge 57, 58 on which the spider 36 is vertically supported.

Figure 7:
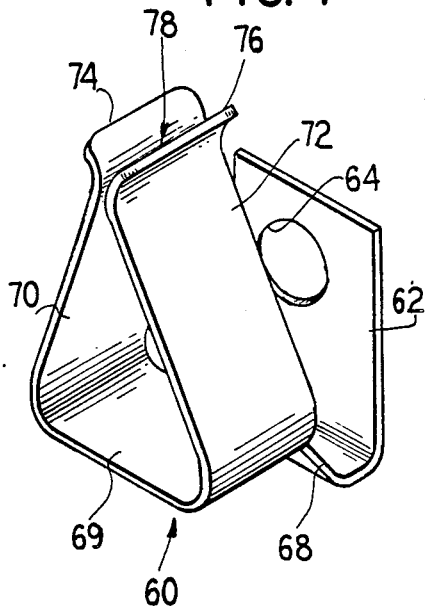
FIG. 7 is a perspective view of the retaining clip alone.

A hold-down or retaining clip 60 is secured to the down-turned flange 56 of the top wall 34 opposite the electrical plug 32. The retaining clip 60, which is shown in greater detail in FIG. 7, has a vertical rear wall 62 with a hole 64 therethrough for receiving a rivet 66 to secure the clip 60 to a back side 67 of the down-turned flange 56. The rear wall 62 is connected by a U-shaped web 68 to a horizontal web 68 which has two upwardly directed and opposite side walls 70, 72 connected thereto. The side walls 70, 72 are angled toward one another and have top ends 74, 76 which are angled outwardly so as to define a funnel-like upward-opening slot 78 at the top of the clip 60. By attaching the clip rear wall 62 to the back side 67 of the flange 56 and having the bottom wall 69 pass under and in close proximity to a bottom edge 79 of the flange 56, the clip 60 is prevented from rotating while using only a single rivet 66.

The leg 40 of the spider 36 which is opposite the opening 28 in the burner bowl 30 engages in the slot 78 and the opposed walls 70, 72 of the clip 60 are urged away from one another by the insertion of the spider leg 40. However, since the clip 60 is formed of a resilient metal material, such as spring steel, the spider leg 40 is securely gripped by the opposed walls 70, 72 of the clip 60 and thus the spider 36 is prevented from moving vertically or horizontally.

The burner bowl 30, 50 also has a second hole 80 (FIG. 4) formed in the annular ledge 57, 58 therein opposite the first hole 28. The second hole 80 is just large enough to receive the upwardly directed walls 70, 72 of the clip 60 and thus the burner bowl 30, 50 is also prevented from moving vertically or horizontally once the spider leg 40 is captured by the clip 60 (See FIG. 5). Opening of the slot 78 by the spider leg 40 causes the opposed walls 70, 72 to press against and thus secure the burner bowl 30, 50.

The walls 70, 72 of the clip 60, by projecting upwardly through the burner bowl 30, 50, are visible and thus the connection between the spider leg 40 and the walls 70, 72 of the clip 60 can be visually checked to be sure that the spider 36 is properly aligned relative to the clip 60.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A clip for removably securing a support spider of a heating unit to a top wall of an appliance comprising:
   - a generally vertical rear wall for attachment of said clip to said top wall of said appliance;
   - a bottom wall connected to said rear wall;
   - a web having a U-shaped cross section connecting said bottom wall to said rear wall; and
   - a pair of opposed, generally vertical side walls;
     - said sidewalls being spaced from each other at their attachment to said bottom wall, being angled toward one another thereabove, and having top ends bent outwardly to angel away from each other thereby defining a funnel-like upward opening slot at a top of the clip.

2. A clip according to claim 1, wherein said clip is formed of a resilient metal material.

3. A clip according to claim 1, wherein said rear wall has an aperture therethrough for receiving a fastening member.

4. A clip according to claim 1, wherein a bight of said U-shaped web extends below said bottom wall.

5. A clip according to claim 4, wherein a bight of said U-shaped web extends below said bottom wall.

6. A clip for removably securing a support spider of a heating unit to a vertical flange of a top wall of an appliance comprising:
   - a generally vertical rear wall having a face for engagement with a back side of said vertical flange;
   - a bottom wall;
   - a web having a U-shaped cross-section connecting said bottom wall to said rear wall, said web positioning said bottom wall on a front side of said vertical flange; and
   - a pair of opposed, generally vertical side walls attached to said bottom wall;

said sidewalls being spaced from each other at their attachment to said bottom wall, being angled toward one another thereabove, and having top ends bent outwardly to angle away from each other thereby defining a funnel-like upward opening slot at a top of the clip.

7. A clip according to claim 6, wherein said clip is formed of a resilient metal material.

8. A clip according to claim 6, wherein said rear wall has an aperture therethrough for receiving a fastening member.

9. A securing clip attachable to a vertical flange comprising:

a generally vertical rear wall having face means for engagement with a back side of said vertical flange;

a bottom wall;

web means connecting said bottom wall to said rear wall for positioning said bottom wall on a front side of said vertical flange wherein said web is U-shaped in cross-section; and a pair of opposed, generally vertical side walls attached to said bottom wall for securing an object therebetween.

10. A clip according to claim 9, wherein said clip is formed of a resilient metal material.

11. A clip according to claim 9, wherein said rear wall has an aperture therethrough for receiving a fastening member.

12. A clip according to claim 9, wherein a bight of said U-shaped web extends below said bottom wall.

* * * * *